United States Patent [19]

Storey

[11] Patent Number: 4,742,750

[45] Date of Patent: May 10, 1988

[54] ADJUSTABLE FINE TUNING BRIDGE SYSTEM AND TREMOLO FOR STRINGED MUSICAL INSTRUMENTS

[76] Inventor: David C. Storey, 13801 Gershon Pl., Santa Ana, Calif. 92705

[21] Appl. No.: 880,830

[22] Filed: Jul. 1, 1986

Related U.S. Application Data

[63] Continuation-in-part of Ser. No. 807,315, Dec. 10, 1985, abandoned.

[51] Int. Cl.[4] ..... G10D 3/12

[52] U.S. Cl. ..... 84/313; 84/267; 84/298

[58] Field of Search ..... 84/298, 299, 313

[56] References Cited

U.S. PATENT DOCUMENTS

| | | | |
|---|---|---|---|
| 319,188 | 6/1885 | Brinsmead | 84/205 |
| 3,241,418 | 3/1966 | Fender | 84/313 |
| 4,171,661 | 10/1979 | Rose | 84/313 |
| 4,361,068 | 11/1982 | Schaller | 84/299 |
| 4,430,919 | 2/1984 | Matsui | 84/299 |
| 4,541,320 | 9/1985 | Sciuto | 84/298 |
| 4,608,905 | 9/1986 | Takabayashi | 84/313 |
| 4,649,789 | 3/1987 | Wadatsu | 84/298 |
| 4,656,915 | 4/1987 | Osuga | 84/313 |

FOREIGN PATENT DOCUMENTS

| | | | |
|---|---|---|---|
| 683531 | 2/1965 | Italy | 84/313 |

*Primary Examiner*—Lawrence R. Franklin
*Attorney, Agent, or Firm*—Laubscher & Laubscher

[57] ABSTRACT

An improved fulcrum tremolo is disclosed, characterized by a unique mounting system and a novel adjustable bridge and fine turning assembly. A pair of screws having a blade-like heads are connected with the body of a musical instrument. The tremolo is arranged in a recess in the body of the instrument and includes in its forward edge tapered recesses to receive the screw head edges for pivotal movement thereabout. An adjustable bridge and fine turning assembly for the instrument strings is connected with the tremolo. For each string there is provided a body portion having a pair of rollers for supporting the string, and a tubular member for receiving the string. The tubular member is arranged in a recess within the tremolo. Harmonic tuning is adjusted by sliding the body portion and tube within its recess longitudinally, essentially without altering the tuning of the string. A string securing member is connected with the tremolo to vary the tension of each string. Each string securing member includes a thumbscrew for rotating the member relative to the tremolo to individually adjust the tension of each string, the thumbscrews being vertically offset to provide a low profile tremolo.

22 Claims, 2 Drawing Sheets

FIG. 1
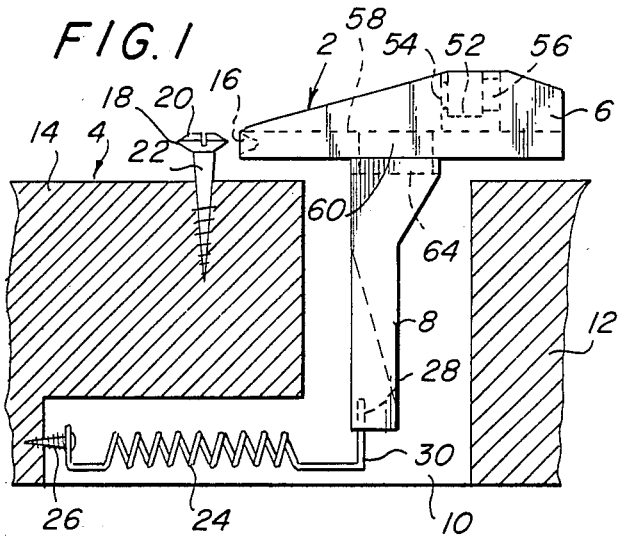
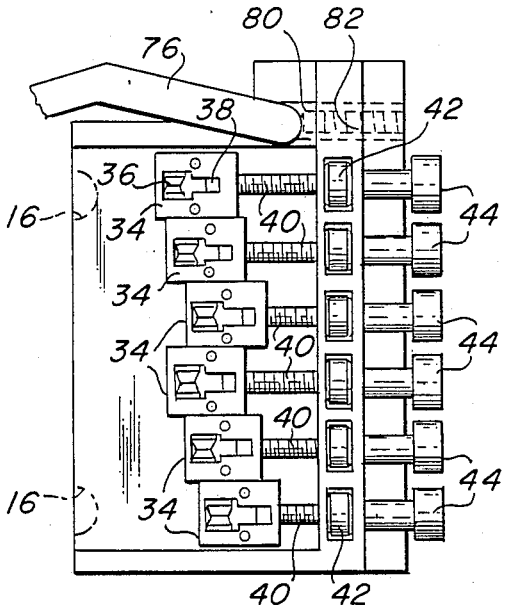
FIG. 2
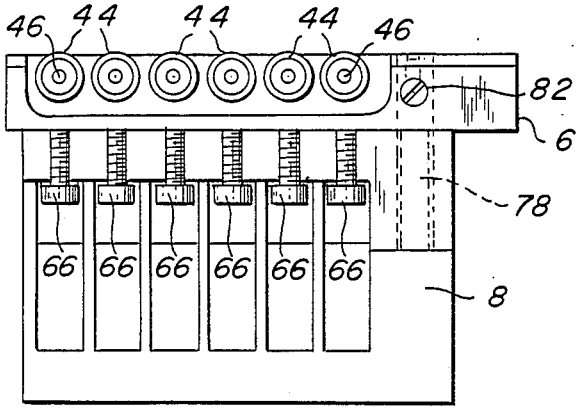
FIG. 3
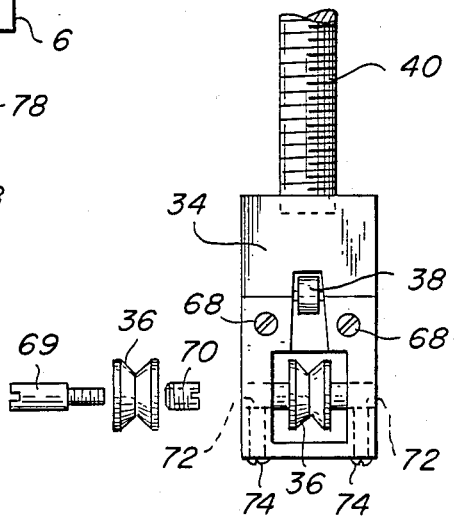
FIG. 4 FIG. 5
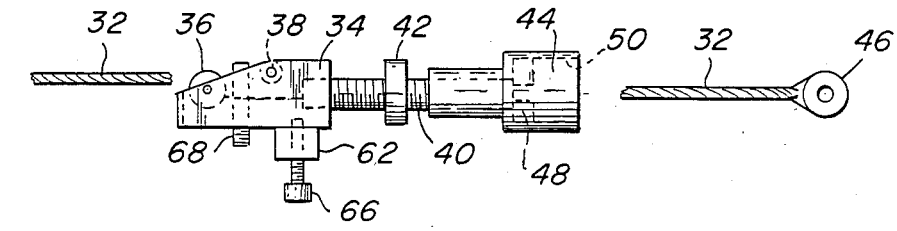

FIG. 6
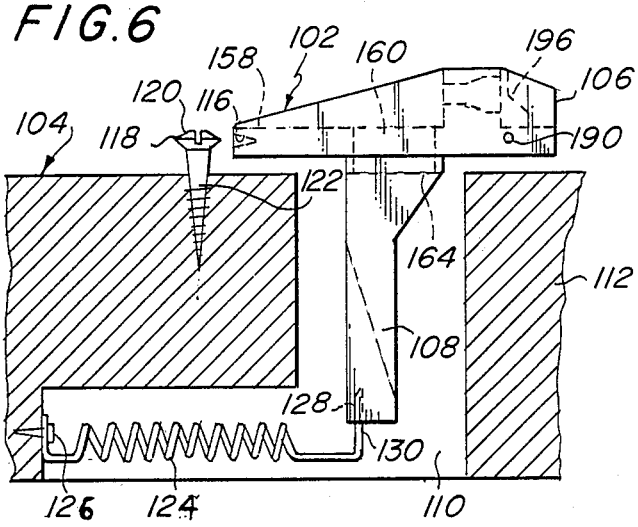
FIG. 7
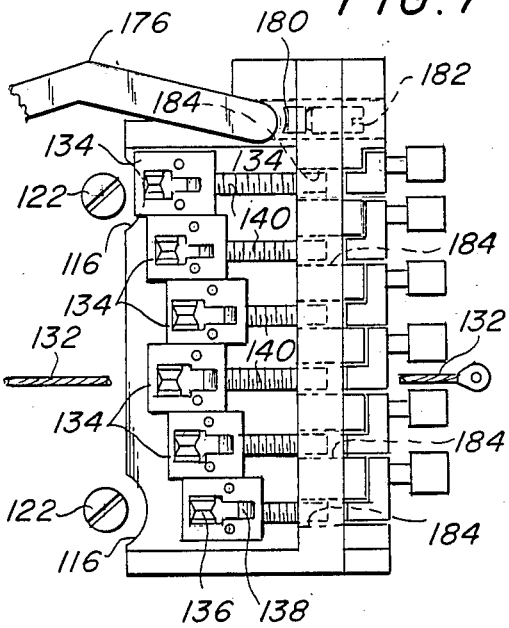
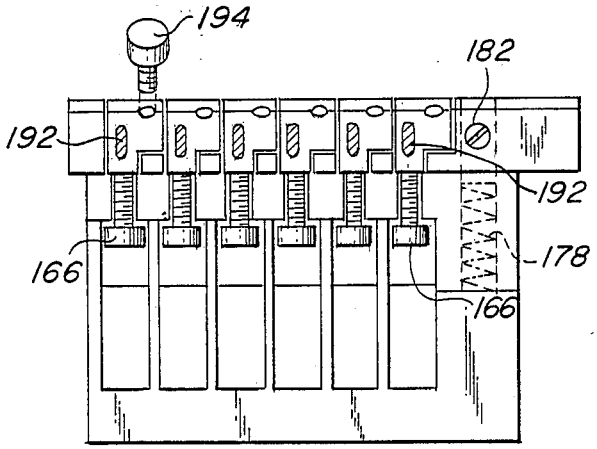
FIG. 8
FIG. 9
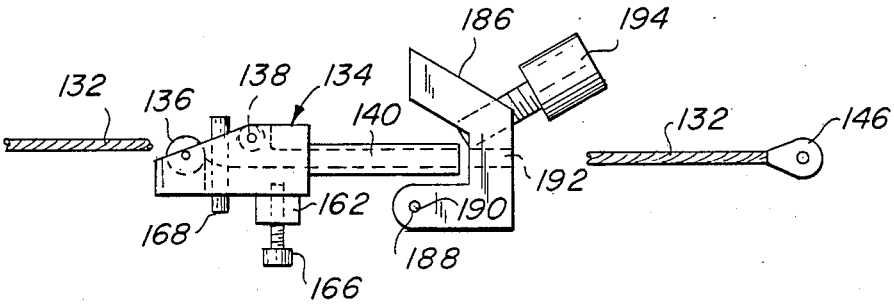

ADJUSTABLE FINE TUNING BRIDGE SYSTEM AND TREMOLO FOR STRINGED MUSICAL INSTRUMENTS

BACKGROUND OF THE INVENTION

This application is a continuation-in-part of application Ser. No. 807,315 filed Dec. 10, 1985, now abandoned.

The present invention relates to an improved adjustable bridge and fine tuning assembly for use with a novel fulcrum tremolo on a stringed musical instrument such as a guitar.

BRIEF DESCRIPTION OF THE PRIOR ART

Fulcrum tremolos are well known in the patented prior art as evidenced by the U.S. Pat. Nos. 2,741,146 to Fender and 4,475,432 Stroh. The Fender patent, for example, discloses a tremolo bridge for stringed instruments including a beveled fulcrum ridge about which the tremolo pivots. The strings of the instrument are connected with the tremolo bridge.

The Stroh patent discloses a fulcrum bridge tremolo having adjustable bridge elements for each string of a musical instrument. An angle plate having an angle groove is connected with the body of the instrument, and the tremolo has a tapered leading edge resembling a knife blade which fits within the groove of the angle plate. Pivotal movement of the tremolo is about the leading edge thereof to produce a vibrato effect.

With fulcrum tremolos, it is important to provide the pivot mounting with as little friction as possible. This is accomplished by providing a sharp pivot edge, whereby the surface area of the pivot mount is minimized.

While the prior fulcrum tremolos normally operate satisfactorily, the beveled or tapered edges thereof have a tendency to become dull as a result of wear. As the fulcrum edges are dulled, the area of surface contact at the pivot mount increases, thereby increasing the friction at the mounting. Consequently pivot motion of the prior fulcrum tremolos becomes erratic and difficult to control, greatly inhibiting tremolo performance. The only way to overcome the wear in the prior fulcrum tremolos is to replace the entire tremolo assembly.

The present invention was developed in order to overcome these and other drawbacks of prior fulcrum tremolos by providing a tremolo member which is not susceptible to wear and which includes an improved adjustable bridge fine tuning system.

SUMMARY OF THE INVENTION

Accordingly, it is a primary object of the present invention to provide a fulcrum tremolo including integral horizontal and vertical portions, the vertical portion being arranged in a recess contained in the body portion of a stringed musical instrument and the horizontal portion being arranged adjacent the upper surface of the instrument body portion. The leading edge of the tremolo horizontal portion contains tapered recesses adapted to receive fulcrum blades connected with the instrument body portion. More particularly, a pair of screws are threadably connected with the instrument body portion, the head portions of the screws having a sharp circumferential edge which functions as the fulcrum blade and which are arranged in the tremolo recesses. When the instrument strings are connected with the tremolo and when the tremolo is pivoted about the screw head, the tension of the strings is varied to produce a vibrato effect.

In accordance with a more particular object of the invention, the instrument strings bias the tremolo in one direction about the screw heads and one or more springs are connected between the instrument body portion and the tremolo vertical portion for biasing the tremolo in the other direction.

According to another object of the invention, a tremolo arm is rotatably connected with the tremolo to pivot the tremolo about the screw heads to produce the vibrato effect.

According to yet another object of the invention, the tremolo includes an adjustable bridge and fine tuning assembly connected therewith for individually supporting and fine tuning the instrument strings.

According to a more specific object of the invention, the adjustable bridge system for each string includes a body portion, a first roller adjustably connected with the body portion for supporting and controlling the intonation of the string, a hollow tube connected at one end with the body portion for receiving the string, and a clamping device for securing the adjustable bridge system in a selected vertical and longitudinal position relative to the tremolo.

According to a further object of the invention, a string securing device including a generally U-shaped bracket for each string is rotatably connected with the tremolo horizontal portion. The bracket contains a through-bore for receiving a string, and a thumbscrew is threadably connected with the bracket and operable to rotate the bracket relative to the tremolo to vary the tension of each string.

BRIEF DESCRIPTION OF THE FIGURES

Other objects and advantages of the present invention will become apparent from a study of the following specification when viewed in the light of the accompanying drawing in which:

FIG. 1 is a partial sectional front view of the fulcrum tremolo according to the invention arranged in a recess in the body portion of a musical instrument;

FIG. 2 is a top plan view of the tremolo of FIG. 1 with the adjustable bridge fine tuning system and tremolo arm connected therewith;

FIG. 3 is a side plan view of the tremolo of FIG. 1 with the adjustable bridge fine tuning system and saddle clamping device;

FIG. 4 is an exploded plan view of the adjustable bridge fine tuning assembly according to the invention;

FIG. 5 is a detailed exploded view of the adjustable connection of the first roller with the body portion of the adjustable bridge.

FIGS. 6, 7, and 8 are front, top, and side views, respectively, of an alternate embodiment of the adjustable bridge fine tuning assembly according to the invention; and FIG. 9 is an exploded plan view of the adjustable bridge fine tuning assembly of FIGS. 6–8.

DETAILED DESCRIPTION

As shown in FIG. 1, the subject invention relates to an improved fulcrum tremolo 2 for use in connection with a stringed musical instrument 4 such as a guitar to produce a vibrato effect. The tremolo includes a horizontal top portion 6 and an integral vertical leg 8 which is arranged in a recess 10 in the body portion 12 of the instrument. The horizontal top portion 6 is arranged adjacent the upper surface 14 of the instrument body portion.

The leading edge of the tremolo horizontal portion 6, i.e. the edge facing in the direction of the neck portion of the instrument, contains a pair of spaced tapered recesses 16 each of which receives the sharp circumferential edge 18 of the head 20 of a pair of screws 22 threadably connected with the instrument body portion. As will be developed in greater detail below, the tremolo pivots about the screw head edges to produce a vibrato effect in the strings of the instrument. A plurality of springs 24 are connected at one end with the instrument body portion 12 by any suitable means such as screws 26 and at the other end with the lower portion of the vertical leg 8 of the tremolo. For example, the leg may contain recesses 28 for receiving a hook 30 at the end of each of the springs 24.

As shown in FIG. 2, the strings of the musical instrument are connected with the tremolo horizontal portion by an adjustable fine tuning assembly. As is known in the art, one end of each string is connected with the head of the instrument, and usually with tuning pegs (not shown). A string lock or clamp may be provided behind the nut of the instrument for clamping the ends of the strings and to keep them in tune during operation of the tremolo. The other ends of the strings are connected with the fine tuning assembly mounted on the tremolo. The tension of the strings normally biases the tremolo 2 in one direction of rotation about the screw head edges 18 while the springs 24 normally bias the tremolo in the other direction to stabilize the tremolo in a rest position.

As shown more particularly in FIGS. 2–4, a plurality of adjustable bridge elements and fine tuning devices are provided, there being one element and device for each string 32 of the instrument. In this manner, the bridge element for each string may be adjusted, and the tension of each string is adjustable for fine tuning.

The adjustable bridge assembly for each string includes a bridge body portion 34 having a bridge roller 36 rotatably, adjustably connected with the forward portion thereof for supporting the instrument string. The bridge roller is preferably a saddle roller. A second roller 38 is also connected with the body portion 34 to the rear of and on the opposite side of the string from the bridge roller.

A threaded tube 40 is connected at one end with the rear of the bridge body portion 34. A collet 42 is arranged on the exterior of the tube and is threadably connected therewith. A hollow string securing device 44 is threadably connected with the other end of the tube. The instrument string 32 passes over the roller 36, under the roller 38, through the tube 40 and the string securing device 44 and terminates in a ball end 46. The string securing device, which in essence is a threaded nut, has an inner bearing surface 48 and a spring circlip 50 for retaining or securing the ball end 46 of the string.

The tremolo horizontal portion 6 contains in the upper surface thereof a plurality of recesses 52 adapted to receive the collets 42 of each bridge and fine tuning assembly. A pair of longitudinal openings 54, 56 communicate with the recess and are adapted to receive the threaded tube 40 as shown in FIGS. 1 and 2. The tremolo horizontal portion also has a horizontal bridge support surface 58 containing a plurality of vertical slots 60 each being adapted to receive the vertical protrusion 62 of each bridge body portion 34, respectively. The lower surface 64 of each slot 60 contains an opening adapted to receive a clamping bolt 66 which is threadably connected with the vertical protrusion 62 of the bridge body portion 34. The bridge body portion 34 also has a pair of vertical threaded openings for receiving height adjustment screws 68, the lower ends of which engage the horizontal surface 58.

In order to adjust the bridge saddle roller for each string, the clamping bolt 66 is loosened and the collet rotated to longitudinally displace the bridge body portion 34 relative to the tremolo horizontal portion 6, the clamping bolt also being displaced through the slot 60. With the longitudinal position of the bridge adjusted, the height of each bridge body portion relative to the tremolo surface 58 is adjusted by operating the height adjustment screws 68. A unique feature of the invention is that the height adjustment screws may be adjusted unevenly to provide a tilt to the bridge body portion if desired. Once the longitudinal and height adjustments have been made, the clamping bolt 66 is tightened, whereby the bolt head abuts against the slot bottom surface 64 to secure the body portion 34 in its adjusted position. Once secured, the bridge body portion only engages the tremolo via the height adjusting screws 68, the clamping bolt 66, and the collet 42.

As shown in FIG. 5, each saddle roller 36 of the bridge system is also laterally adjustable. More particularly, the saddle roller 36 is mounted on a roller pin 69 and connected therewith by a threaded cap 70. The roller pin 69, which serves as the axle for the roller 36, passes through lateral openings 72 in the bridge body portion. When the lateral position of the pin 69, and thus the roller 36, is set, a pair of clamping screws 74 on either side of the roller are tightened to secure the roller in the selected lateral position. Adjustment of the pin cap 70 controls the rotational play of the roller 36 relative to the pin.

A tremolo arm 76 is connected with the tremolo 2 as shown in FIGS. 2 and 3. More particularly, the tremolo contains a threaded opening 78 for receiving a threaded end of the tremolo arm. An insert 80, preferably formed of nylon, is arranged in a horizontal passage adjacent the arm threaded opening and a screw 82 is operable to displace the insert against the tremolo arm to control the rotational play of the arm 76 relative to the tremolo 2.

By raising and lowering the arm, the tremolo 2 is rotated or pivoted about the screw head edges 18 to produce a vibrato effect in the instrument strings connected between the tremolo and the head or nut of the instrument. Repeated operation of the tremolo has a tendency to detune the instrument strings owing to repeated stretching of the strings. By operating the string securing devices 44, the tension of each string can be individually adjusted to fine tune the strings.

Referring now to the preferred embodiment of FIGS. 6–9, the tremolo 102 is again arranged in a recess 110 in the body portion 112 of a musical instrument 104. As before, the tremolo has vertical leg 108 and horizontal top 106 portions. The tremolo horizontal top portion 106 contains a pair of recesses 116 in the front edge thereof to receive the edge 118 of the head portion 120 of screws 122 connected with the instrument. The tremolo pivots about the screw head edges and a plurality of springs 124 are connected between the instrument body and the lower end of the tremolo leg in the same manner as in the embodiment of FIG. 1.

The adjustable bridge assembly for each string 132 includes a body portion 134 having a bridge roller 136 and a secondary roller 138 rotatably connected therewith. A hollow tube 140 is connected at one end with the rear of the bridge body portion and receives the instrument string 132 which passes over the bridge saddle roller 136 and under the secondary roller.

As shown in FIG. 7, the tremolo horizontal portion 106 contains in the upper surface thereof a plurality of recesses 184 adapted to receive the tubes 140 of each bridge body portion 134. The horizontal portion 106 also has a horizontal bridge support surface 158 containing a plurality of vertical slots 160 each adapted to receive the vertical protrusion 162 of each bridge body portion 134, respectively. The lower surface 164 of each slot 160 contains an opening adapted to receive a clamping bolt 166 connected with the bridge body protrusion 162. Height adjustment screws 168 are also provided in the bridge body portion 134. The bridge is adjusted in the same manner as the bridge of the embodiment of FIGS. 1-5.

Referring now to FIGS. 8 and 9, a generally U-shaped string securing device or bracket 186 for each string is pivotally connected with the tremolo horizontal portion 106 by a pin 188 which passes through aligned transverse openings 190 in the tremolo and in the string securing device. The securing device contains a through-bore 192 for receiving the string 132, the ball end 146 thereof abutting against the rear surface of the string securing device when the strings are initially tensioned by the tuning pegs. The string securing device 186 further includes a thumbscrew 194 threadably connected therewith in vertically offset relation with the through-bore 192 as shown in FIG. 8 to provide a lower profile of the tremolo and lower position of the thumbscrews. The lower profile eliminates the concern of the instrument player of accidentally striking one of the fine tuning screws and putting the instrument out of tune during a performance. The end portion of the thumbscrew butts against a surface 196 on the tremolo horizontal portion. As the thumbscrew is rotated, the string securing device pivots about the pin 188 to longitudinally displace the string end, thereby to vary the tension of the string. Thus the tension of each string may be varied individually by operation of the thumbscrews of each string securing device.

The improved fulcrum tremolo assembly of the invention greatly increases the tuning stability and sustain of the strings during exaggerated use of the vibrato effect. Owing to the unique use of screw heads as the pivot points for the tremolo, wear of the screw heads may be compensated by rotating the screws 90°-180°, thereby exposing an unused sharp edge portion of the screw heads to the tremolo recesses. When the entire screw head has become worn, the screws may easily be replaced at far lesser expense than replacing the entire tremolo assembly.

In order to allow the tremolo of the invention to be fitted to the greatest number of musical instruments, there may be slight variations in the positioning of the tremolo bridge. Furthermore, to provide correct harmonic tuning within the adjustment range of each bridge saddle roller, pivot screws having heads of larger or smaller diameters may be used to position the tremolo further or nearer to the instrument fingerboard.

The improved adjustable bridge and fine tuning assembly of the invention offers a number of advantages over prior devices. For example, as shown in FIG. 4, each instrument string lies in a generally straight-through disposition relative to the bridge/fine turning system. During tremolo use, when complete detensioning of the string occurs, accurate pitch recovery is obtained by eliminating the friction points behind the string witness or bridge contact point. Moreover, the auxiliary roller prevents the string from lifting off the saddle roller when the tremolo arm is fully depressed.

The individual height adjustment for each bridge body portion enables the user to correctly set the arc of the strings to the arc of the instrument's fingerboard and likewise to the individual harmonic tuning adjustment. By securing the bridge body portions in an adjusted position, movement of the bridge roller and body portion—which causes buzzing when the instrument strings are played—is eliminated. Buzzing is also eliminated by providing lateral adjustment of the saddle rollers and by controlling the rotational play thereof. Finally, the fine tuning is situated at a very low profile and therefore can not be accidentally struck during playing of the instrument.

The individual parts of the improved fulcrum tremolo and adjustable bridge/fine tuning assembly are preferably formed of a high quality metal such as brass or steel and the pivot screw is preferably formed of high tensile strength carbon steel.

While in accordance with the provisions of the patent statutes the preferred forms and embodiments of the invention have been illustrated and described, it will become apparent to those skilled in the art that various changes and modifications may be made without deviating from the inventive concepts set forth above.

What is claimed is:

1. Apparatus for producing a vibrato effect in the strings of a musical instrument, comprising (a) a tremolo including horizontal and vertical portions, said tremolo vertical portion being arranged in a recess contained in the body portion of the instrument and said tremolo horizontal portion being arranged adjacent the upper surface of the instrument body portion, one edge of said tremolo horizontal portion containing at least one recess; and (b) means pivotally connecting said tremolo with the instrument body portion, said connecting means comprising screw means threadably connected with the instrument body portion, said screw means including a head portion having a sharp circumferential edge, said tremolo recess receiving a portion of said sharp edge and pivoting thereabout, whereby when the instrument strings are connected with said tremolo and when said tremolo is pivoted about said sharp edge, the tension of the strings is varied to produce a vibrato effect.

2. Apparatus as defined in claim 1, wherein said tremolo comprises a fulcrum tremolo.

3. Apparatus as defined in claim 2, wherein the instrument strings bias said tremolo in one direction about said sharp edge, and further comprising spring means connected between the instrument body portion and said tremolo vertical portion for biasing said tremolo in the opposite direction.

4. Apparatus as defined in claim 3, and further comprising a tremolo arm rotatably connected with said tremolo for pivoting said tremolo about said sharp edge to produce the vibrato effect.

5. Apparatus as defined in claim 4, and further comprising means for adjusting the rotational play of said tremolo arm relative to said tremolo.

6. An adjustable bridge system for the strings of a musical instrument, comprising (a) a base;

(b) individually adjustable bridge means connected with said base for supporting the individual instrument strings, respectively, each of said bridge means including (1) a body portion;

(2) means for adjusting the vertical and longitudinal displacement of said body portion relative to said base;

(3) a first roller rotatably connected with said body portion for supporting an individual string;

(4) a second roller rotatably connected with said body portion on the opposite side of the string from said first roller; and (5) a hollow threaded tube connected at one end with said body portion for receiving the string.

7. Apparatus as defined in claim 6, and further comprising means for clamping said body portions in a predetermined longitudinal and vertical position relative to said base.

8. Apparatus as defined in claim 7, wherein each of said body portions include means for adjusting the lateral position of said first roller relative to said body portion.

9. An adjustable bridge system for the strings of a musical instrument, comprising (a) a base;

(b) individually adjustable bridge means connected with said base for supporting the individual instrument strings, respectively, each of said bridge means including (1) a body portion;

(2) means for adjusting the vertical displacement of said body portion relative to said base;

(3) a first roller connected with said body portion for supporting an individual string;

(4) means for adjusting the lateral position of said first roller relative to said body portion;

(5) means for adjusting the rotational play of said first roller relative to said base;

(6) a second roller connected with said body portion on the opposite side of the string from said first roller; and (7) a hollow tube connected at one end with said body portion for receiving the string.

10. Apparatus as defined in claim 9, and further comprising means for clamping said body portions in a predetermined longitudinal and vertical position relative to said base.

11. Apparatus as defined in claim 10, wherein said base contains a plurality of slots and said clamping means comprise a plurality of bolts threadably connected with said body portions, respectively, each of said bolts passing through one of said slots, whereby when each body portion is adjusted to a desired longitudinal and vertical position, said bolts are tightened against the edges defining said slots to fix said body portions in the desired position.

12. Apparatus as defined in claim 11, wherein said base comprises a tremolo.

13. Apparatus as defined in claim 12, and further comprising means for rotatably connecting said tremolo with the musical instrument body.

14. Apparatus as defined in claim 13, wherein said tremolo comprises a fulcrum tremolo containing at least one tapered recess in the forward edge thereof.

15. Apparatus as defined in claim 14, wherein said connecting means comprises screw means threadably connected with the musical instrument body, said screw means each having a head portion having a sharp circumferential edge, said tremolo recesses receiving a portion of said screw heads and pivoting thereabout.

16. Apparatus as defined in claim 15, wherein the instrument strings bias said tremolo in one direction of rotation about said screw heads, and further comprising spring means connected between the instrument body and said tremolo for biasing said tremolo in the opposite direction.

17. Apparatus as defined in claim 16, and further comprising a tremolo arm rotatably connected with said tremolo for pivoting said tremolo about said screw head to produce a vibrato effect.

18. Apparatus as defined in claim 17, and further comprising means for adjusting the rotational play of said tremolo arm relative to said tremolo.

19. Apparatus as defined in claim 18, and further comprising string retaining means rotatably connected with said tremolo horizontal portion, said string retaining means containing a through-bore for receiving one end of the string and including a thumbscrew threadably connected with said string retaining means in offset relation with said through-bore for rotating said string retaining means relative to said tremolo horizontal portion, thereby to vary the tension of the string.

20. Apparatus as defined in claim 10, wherein said longitudinal adjustment means is arranged on said tube intermediate the ends thereof for longitudinally adjustably connecting said body portion with said base, and further comprising string securing means threadably connected with the other end of said tube for holding the end of the string, said string securing means being displaceable along said threaded tube upon rotation thereof relative to said tube to vary the tension of and to fine tune the string.

21. Apparatus as defined in claim 20, wherein said longitudinal adjustment means comprises a threaded collet.

22. Apparatus as defined in claim 21, wherein said base contains a plurality of recesses for receiving said collets, whereby upon rotation of said collets, said collets are retained in said recesses and said threaded tubes and body portions are longitudinally displaced relative to said base.

* * * * *